US010538403B2

(12) United States Patent
Oohashi et al.

(10) Patent No.: US 10,538,403 B2
(45) **Date of Patent: *Jan. 21, 2020**

(54) BELT-FORM BODY CONVEYOR

(71) Applicant: IHI Corporation, Tokyo (JP)

(72) Inventors: Rui Oohashi, Tokyo (JP); Kensuke Hirata, Tokyo (JP); Tomoo Kusumi, Tokyo (JP); Mareto Ishibashi, Tokyo (JP); Noriaki Hasegawa, Tokyo (JP)

(73) Assignee: IHI CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/971,506

(22) Filed: May 4, 2018

(65) Prior Publication Data

US 2018/0251329 A1 Sep. 6, 2018

Related U.S. Application Data

(63) Continuation of application No. PCT/JP2016/087383, filed on Dec. 15, 2016.

(30) Foreign Application Priority Data

Mar. 4, 2016 (JP) ..... 2016-042696

(51) Int. Cl.
*B65H 23/035* (2006.01)
*B65H 23/26* (2006.01)
(Continued)

(52) U.S. Cl.
CPC ..... *B65H 23/035* (2013.01); *B65H 23/048* (2013.01); *B65H 23/24* (2013.01);
(Continued)

(58) Field of Classification Search
CPC .... B65H 23/0324; B65H 23/24; B65H 23/26; B65H 23/035; B65H 20/14; B65H 2406/1115; B65H 23/038; B65H 23/032
See application file for complete search history.

(56) References Cited

U.S. PATENT DOCUMENTS 3,826,416 A * 7/1974 Takagi ..... B65H 23/038 226/196.1
4,200,211 A * 4/1980 Yamagishi ..... B65H 23/0204 226/196.1
(Continued)

FOREIGN PATENT DOCUMENTS

JP 54-162655 A 12/1979
JP 59-128149 A 7/1984
(Continued)

OTHER PUBLICATIONS

Office Action issued in U.S. Appl. No. 15/963,196, dated May 15, 2018, 9 pages.

*Primary Examiner* — Michael C McCullough
(74) *Attorney, Agent, or Firm* — Rothwell, Figg, Ernst & Manbeck, P.C.

(57) ABSTRACT

A belt-form body conveyor that conveys a belt-form body includes a plurality of non-contact guide portions over which portions of the belt-form body are wound, and that support the belt-form body in a non-contact manner, and a drive unit that, when viewed in a direction that is perpendicular to a surface of the belt-form body before the belt-form body is supplied to the plurality of non-contact guide portions, causes at least two non-contact guide portions out of the plurality of non-contact guide portions to rotate in the same direction and by the same angle.

4 Claims, 11 Drawing Sheets

(51) Int. Cl.
*B65H 23/04* (2006.01)
*B65H 23/24* (2006.01)
*B65H 23/32* (2006.01)

(52) U.S. Cl.
CPC ..... *B65H 23/26* (2013.01); *B65H 23/32* (2013.01); *B65H 2404/15212* (2013.01)

(56) References Cited

U.S. PATENT DOCUMENTS 5,558,263 A 9/1996 Long
5,979,731 A * 11/1999 Long ..... B65H 23/24 226/7
6,450,382 B1 * 9/2002 Ohno ..... B65H 23/0204 226/21
6,705,220 B2 * 3/2004 Boucher ..... B65H 23/32 101/225
2002/0195009 A1 * 12/2002 Boucher ..... B65H 23/32 101/228
2014/0151493 A1 * 6/2014 Slyne ..... B29C 70/386 242/615.1
2015/0124016 A1 * 5/2015 Bildstein ..... B65H 23/038 347/16
2018/0237248 A1 * 8/2018 Oohashi ..... B65H 20/14

FOREIGN PATENT DOCUMENTS

JP 62-157165 A 7/1987
JP 62-180849 A 8/1987
JP 2-182656 A 7/1990
JP 5-124758 A 5/1993
JP 5-139589 A 6/1993
JP 6-32502 A 2/1994
JP 06-032502 A 2/1994
JP 6-503793 A 4/1994
JP 06-144663 A 5/1994
JP 7-309490 A 11/1995
JP 8-53246 A 2/1996
JP 2001-192157 A 7/2001
JP 2007-70084 A 3/2007
JP 2009-46285 A 3/2009
JP 2010-265062 A 11/2010
JP 2015-801 A 1/2015
JP 2015-86075 A 5/2015
WO 92/11194 A1 7/1992

* cited by examiner

BELT-FORM BODY CONVEYOR

CROSS-REFERENCE TO RELATED APPLICATIONS

This application is a Continuation Application based on International Application No. PCT/JP2016/087383, filed Dec. 15, 2016, which claims priority on Japanese Patent Application No. 2016-042696, filed Mar. 4, 2016, the contents of which are incorporated herein by reference.

TECHNICAL FIELD

The present disclosure relates to a belt-form body conveyor.

BACKGROUND

As is shown in Patent Document 1, for example, a conveyor that is provided with non-contact type turn bars and conveys an aluminum belt-form web is known. In this type of conveyor, jets of fluid are expelled from the turn bar onto the web so that the web is supported in a non-contact manner.

The conveyor described in Patent Document 1 is provided with a turn bar adjuster that alters the position of the turn bar in order to adjust the center position of the web being conveyed and center the web easily and accurately while the web is being conveyed.

Patent Document 1: Japanese Unexamined Patent Application, First Publication No. 2007-70084

When a belt-form body that is fed from a roll body, over which the belt-form body has been wound multiple times, is to undergo processing or the like, the positioning accuracy of the belt-form body in the processing position is crucial. Because of this, the processing position of the belt-form body is fixed by a regulation portion or the like at a predetermined position. On the other hand, there are also cases where the position of the belt-form body on the upstream side of the processing position is unstable due to the winding accuracy of the belt-form body when the belt-form body was being wound onto the roll body, or due to mispositioning of the belt-form body when the belt-form body was being conveyed to the processing position or the like. As a result of this, localized stress acts on portions partway along the length of the belt-form body, and there is a possibility that deformations and the like may be generated in the belt-form body. In particular, in recent years, there are cases where a belt-form body that is made from extremely thin, bendable glass is being conveyed. In such cases, it is necessary to prevent stress from acting on the belt-form body even more than in a conventional case.

In order to prevent this type of deformation in a belt-form body, when relative to portions of the belt-form body that are on the downstream side of the processing position and the like, portions of the belt-form body that are on the upstream-side are displaced in parallel with the width direction of the belt-form body, it is necessary to eliminate this displacement by causing the belt-form body to undergo a parallel displacement without placing any stress on the belt-form body. However, in the conveyor disclosed in Patent Document 1, no consideration is given to the idea of the downstream side of the belt-form body being fixed, and furthermore it is impossible to cause the belt-shaped body to undergo a parallel displacement in the width direction.

SUMMARY

In view of the above-described circumstances, an object of the present disclosure is to make it possible, in a belt-form body conveyor that conveys a belt-form body while supporting the belt-form body in a non-contact manner, for the belt-form body to perform a parallel displacement in the width direction thereof without any stress being placed on the belt-form body.

A belt-form body conveyor according to an aspect of the present disclosure conveys a belt-form body and includes a plurality of non-contact guide portions over which portions of the belt-form body are wound, and that support the belt-form body in a non-contact manner, and a drive unit that, when viewed in a direction that is perpendicular to a surface of the belt-form body before the belt-form body is supplied to the plurality of non-contact guide portions, causes at least two non-contact guide portions out of the plurality of non-contact guide portions to rotate in the same direction and by the same angle.

According to the present disclosure, it is possible, in a belt-form body conveyor that conveys a belt-form body while supporting the belt-form body in a non-contact manner, for the belt-form body to perform a parallel displacement in the width direction thereof without any stress being placed on the belt-form body.

DESCRIPTION OF EMBODIMENTS

Figure 1:
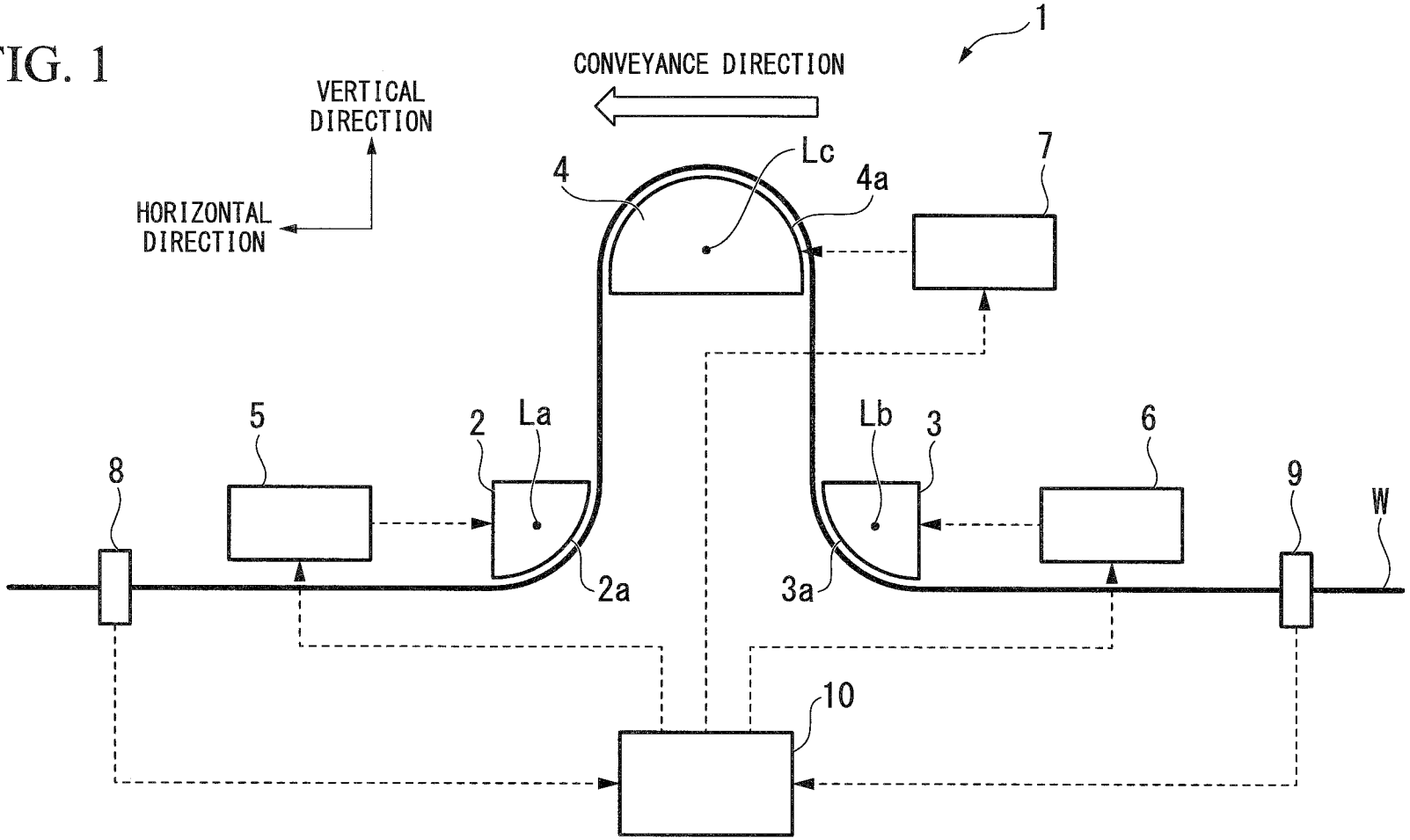
FIG. 1 is a side view schematically representing a structural outline of a belt-form body conveyor according to a first embodiment of the present disclosure.

Hereinafter, embodiments of a belt-form body conveyor according to the present disclosure will be described with reference to the drawings.

Note that, in the drawings described below, the scale of the respective components has been suitably altered in order to make each component a recognizable size.

First Embodiment

Figure 2:
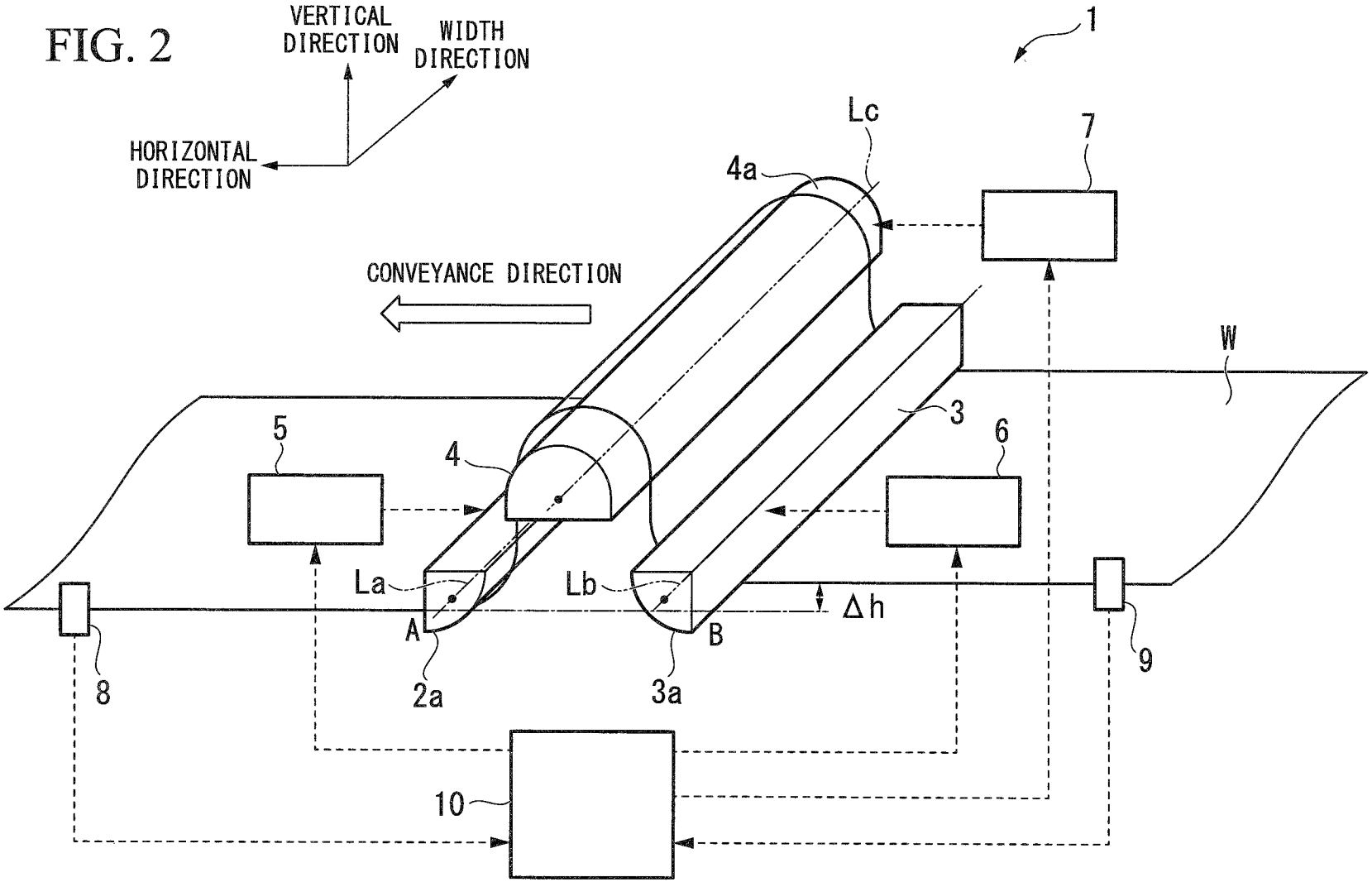
FIG. 2 is a perspective view schematically representing the structural outline of the belt-form body conveyor according to the first embodiment of the present disclosure.

FIG. 1 is a side view schematically representing a structural outline of a belt-form body conveyor 1 of the present embodiment. FIG. 2 is a perspective view schematically representing the structural outline of the belt-form body conveyor 1 of the present embodiment. Note that, in FIG. 1, a state is illustrated in which an axial center of a downstream-side turn bar 2, an axial center of an upstream-side turn bar 3, and an axial center of an inverter turn bar 4 (these are described below) extend in parallel with a width direction of a belt-form body W. Moreover, in FIG. 2, a state is illustrated in which the axial center of the downstream-side turn bar 2, the axial center of the upstream-side turn bar 3, and the axial center of the inverter turn bar 4 are inclined relative to the width direction of the belt-form body W.

As is shown in FIG. 1 and FIG. 2, the belt-form body conveyor 1 is provided with the downstream-side turn bar 2 (i.e., a non-contact guide portion), the upstream-side turn bar 3 (i.e., a non-contact guide portion), the inverter turn bar 4 (i.e., a non-contact guide portion), a downstream-side actuator 5, an upstream-side actuator 6, an inversion actuator 7, a downstream-side edge sensor 8, an upstream-side edge sensor 9, and a control unit 10. Note that, in the belt-form body conveyor 1 of the present embodiment, the belt-form body W is conveyed from the right side towards the left side in FIG. 1 and FIG. 2. Namely, in the present embodiment, as is indicated by the arrows in FIG. 1 and FIG. 2, a direction towards the left-hand side in FIG. 1 and FIG. 2 is the principal conveyance direction of the belt-form body W. Moreover, the right side in FIG. 1 and FIG. 2 is the upstream side in the conveyance direction, while the left side in FIG. 1 and FIG. 2 is the downstream side in the conveyance direction. However, the travel direction of the belt-form body W does change while the belt-form body W is being conveyed in the principal conveyance direction.

The downstream-side turn bar 2 is a hollow rod-shaped component having a circumferential surface that follows a circular arc whose central angle is set to 90°. Of the downstream-side turn bar 2, the upstream-side turn bar 3, and the inverter turn bar 4, the downstream-side turn bar 2 is disposed the furthest to the downstream side in the travel direction of the belt-form body W. As is shown in FIG. 1, the downstream-side turn bar 2 is movably supported by a supporting portion (not shown in the drawings) such that an axial center La of the downstream-side turn bar 2 extends in a horizontal direction, and such that the circumferential surface of the downstream-side turn bar 2 faces downwards and towards the upstream-side turn bar 3 side. A plurality of through holes (not shown in the drawings) are provided in the circumferential surface of the downstream-side turn bar 2, and jets of a fluid that has been supplied from a fluid supply portion (not shown in the drawings) into the interior of the downstream-side turn bar 2 are expelled from these through holes. As a result of the jets of fluid being expelled from the through holes towards the belt-form body W in this way, the belt-form body W is supported in a non-contact manner by the downstream-side turn bar 2. In other words, the circumferential surface of the downstream-side turn bar 2 functions as a non-contact supporting surface 2*a* that supports the belt-form body W without being in contact therewith.

The downstream-side turn bar 2 guides the belt-form body W such that the travel direction of the belt-form body W is altered by 90° as a result of a portion of the belt-form body W, which is being supplied from above, being wound over the non-contact supporting surface 2*a* in a clockwise direction in FIG. 1. In the present embodiment, the belt-form body W that is guided by the downstream-side turn bar 2 travels in such a way that front and rear surfaces thereof are vertical before the belt-form body W arrives at the downstream-side turn bar 2, and travels in such a way that the front and rear surfaces thereof are horizontal after the belt-form body W has passed through the downstream-side turn bar 2. The downstream-side turn bar 2 causes the position of the belt-form body W in the vertical direction (in other words, the position of the belt-form body in the thickness direction) to match the position of the belt-form body W before the belt-form body W is supplied into the upstream-side turn bar 3.

In the same way as the downstream-side turn bar 2, the upstream side turn bar 3 is a hollow rod-shaped component having a circumferential surface that follows a circular arc whose central angle is set to 90°. Of the downstream-side turn bar 2, the upstream-side turn bar 3, and the inverter turn bar 4, the upstream-side turn bar 3 is disposed the furthest to the upstream side in the travel direction of the belt-form body W. The upstream-side turn bar 3 is disposed at the same height as the downstream-side turn bar 2. The upstream-side turn bar 3 is movably supported by a supporting portion (not shown in the drawings) such that an axial center Lb of the upstream-side turn bar 3 extends in parallel with the axial center La of the downstream-side turn bar 2. Moreover, the upstream-side turn bar 3 is disposed such that the circumferential surface of the upstream-side turn bar 3 faces downwards and towards the downstream-side turn bar 2 side. In the same way as in the circumferential surface of the downstream-side turn bar 2, a plurality of through holes (not shown in the drawings) are provided in the circumferential surface of the upstream-side turn bar 3, and jets of a fluid that has been supplied from a fluid supply portion (not shown in the drawings) into the interior of the upstream-side turn bar 3 are expelled from these through holes. As a result of the jets of fluid being expelled from the through holes towards the belt-form body W in this way, the belt-form body W is supported in a non-contact manner by the upstream-side turn bar 3. In other words, the circumferential surface of the upstream-side turn bar 3 functions as a non-contact supporting surface 3*a* that supports the belt-form body W without being in contact therewith.

The upstream-side turn bar 3 guides the belt-form body W such that the travel direction of the belt-form body W is altered by 90° as a result of a portion of the belt-form body W, which is being supplied from the horizontal direction, being wound over the non-contact supporting surface 3*a* in a clockwise direction in FIG. 1. In the present embodiment, the belt-form body W that is guided by the upstream-side turn bar 3 travels in such a way that the front and rear surfaces thereof are horizontal before the belt-form body W arrives at the upstream-side turn bar 3, and travels in such a way that the front and rear surfaces thereof are vertical after the belt-form body W has passed through the upstream-side turn bar 3.

The inverter turn bar 4 is disposed above the downstream-side turn bar 2 and the upstream-side turn bar 3 when viewed in the horizontal direction, and is disposed between the downstream-side turn bar 2 and the upstream-side turn bar 3 when viewed in a vertical direction. The inverter turn bar 4 is a hollow rod-shaped component having a circumferential surface that follows a circular arc whose central angle is set to 180°. The inverter turn bar 4 is movably supported by a supporting portion (not shown in the drawings) such that an axial center Lc of the inverter turn bar 4 extends in parallel with the axial center La of the downstream-side turn bar 2 and the axial center Lb of the upstream-side turn bar 3. Moreover, the inverter turn bar 4 is also disposed such that the circumferential surface of the inverter turn bar 4 faces upwards. In the same way as in the circumferential surface of the downstream-side turn bar 2 and the circumferential surface of the upstream-side turn bar 3, a plurality of through holes (not shown in the drawings) are provided in the circumferential surface of the inverter turn bar 4, and jets of a fluid that has been supplied from a fluid supply portion (not shown in the drawings) into the interior of the inverter turn bar 4 are expelled from these through holes. As a result of the jets of fluid being expelled from the through holes towards the belt-form body W in this way, the belt-form body W is supported in a non-contact manner by the inverter turn bar 4. In other words, the circumferential surface of the inverter turn bar 4 functions as a non-contact supporting surface 4*a* that supports the belt-form body W without being in contact therewith.

The inverter turn bar 4 guides the belt-form body W such that the travel direction of the belt-form body W is altered 180° as a result of a portion of the belt-form body W, which has passed through the upstream-side turn bar 3 and is being supplied from below, being wound over the non-contact supporting surface 4*a* in a counterclockwise direction in FIG. 1. The inverter turn bar 4 reverses the travel direction of the belt-form body W, whose direction has already been altered by the upstream-side turn bar 3, towards the downstream-side turn bar 2. In the present embodiment, the travel direction of the belt-form body W that is guided by the inverter turn bar 4 is inverted 180° after passing through the inverter turn bar 4 from the travel direction thereof before arriving at the inverter turn bar 4.

Figure 3:
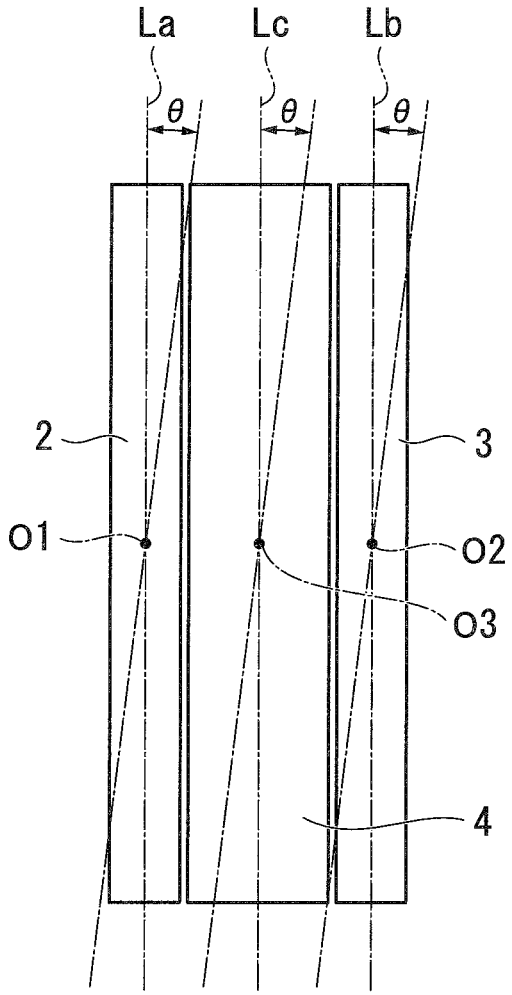
FIG. 3 is a schematic view as seen from above representing a downstream-side turn bar, an upstream-side turn bar, and an inverter turn bar provided in the belt-form body conveyor according to the first embodiment of the present disclosure.

The downstream-side actuator 5 is connected to the downstream-side turn bar 2 via a transmission mechanism (not shown in the drawings), and causes the downstream-side turn bar 2 to rotate. FIG. 3 is a schematic view showing the downstream-side turn bar 2, the upstream-side turn bar 3, and the inverter turn bar 4 from above (i.e., from a direction aligned with a line that is perpendicular to the surface of the belt-form body before being supplied to the non-contact guide portions). In the present embodiment, as is shown in FIG. 3, the downstream-side turn bar 2 is rotated within a horizontal plane by the downstream-side actuator 5 around a center position O1 in a direction aligned with the axial center La of the downstream-side turn bar 2.

The upstream-side actuator 6 is connected to the upstream-side turn bar 3 via a transmission mechanism (not shown in the drawings), and causes the upstream-side turn bar 3 to rotate. In the present embodiment, as is shown in FIG. 3, the upstream-side turn bar 3 is rotated within a horizontal plane by the upstream-side actuator 6 around a center position O2 in a direction aligned with the axial center Lb of the upstream-side turn bar 3.

The inversion actuator 7 is connected to the inverter turn bar 4 via a transmission mechanism (not shown in the drawings), and causes the inverter turn bar 4 to rotate. In the present embodiment, as is shown in FIG. 3, the inverter turn bar 4 is rotated within a horizontal plane by the inversion actuator 7 around a center position O3 in a direction aligned with the axial center Lc of the inverter turn bar 4.

Here, in the present embodiment, under the control of the control unit 10, the downstream-side turn bar 2, the upstream-side turn bar 3, and the inverter turn bar 4 are rotated in the same direction and by the same angle. In other words, as is shown in FIG. 3, when the downstream-side turn bar 2 is rotated towards the right by a rotation angle θ, the upstream-side turn bar 3 and the inverter turn bar 4 are also rotated towards the right by the rotation angle θ.

In this manner, in the belt-form body conveyor 1 of the present embodiment, the downstream-side turn bar 2, the upstream-side turn bar 3, and the inverter turn bar 4 are all capable of rotating. Moreover, the belt-form body conveyor 1 of the present embodiment is provided with the downstream-side actuator 5, the upstream-side actuator 6, and the inversion actuator 7 that, under the control of the control unit 10, cause the downstream-side turn bar 2, the upstream-side turn bar 3, and the inverter turn bar 4 to rotate in the same direction and by the same angle. In the present embodiment, a drive unit of the present disclosure is formed by the downstream-side actuator 5, the upstream-side actuator 6, and the inversion actuator 7.

The downstream-side edge sensor 8 is disposed on the downstream side from the downstream-side turn bar 2, and detects an edge position on one side (in FIG. 1 and FIG. 2 this is the side closest to the viewer) in the width direction of the belt-form body W that has passed through the downstream-side turn bar 2. The upstream-side edge sensor 9 is disposed on the upstream side from the upstream-side turn bar 3, and detects an edge position on one side (in FIG. 1 and FIG. 2 this is the side closest to the viewer) in the width direction of the belt-form body W before arriving at the upstream-side turn bar 3. For example, a laser-based edge sensor may be used as the downstream-side edge sensor 8 and the upstream-side edge sensor 9. The downstream-side edge sensor 8 and the upstream-side edge sensor 9 are electrically connected to the control unit 10, and output their detection results to the control unit 10.

The control unit 10 calculates the rotation angle θ of the downstream-side turn bar 2, the upstream-side turn bar 3, and the inverter turn bar 4 based on the detection results from at least one of the downstream-side edge sensor 8 and the upstream-side edge sensor 9, and controls the downstream-side actuator 5, the upstream-side actuator 6, and the inversion actuator 7 based on the rotation angle θ.

Figure 4:
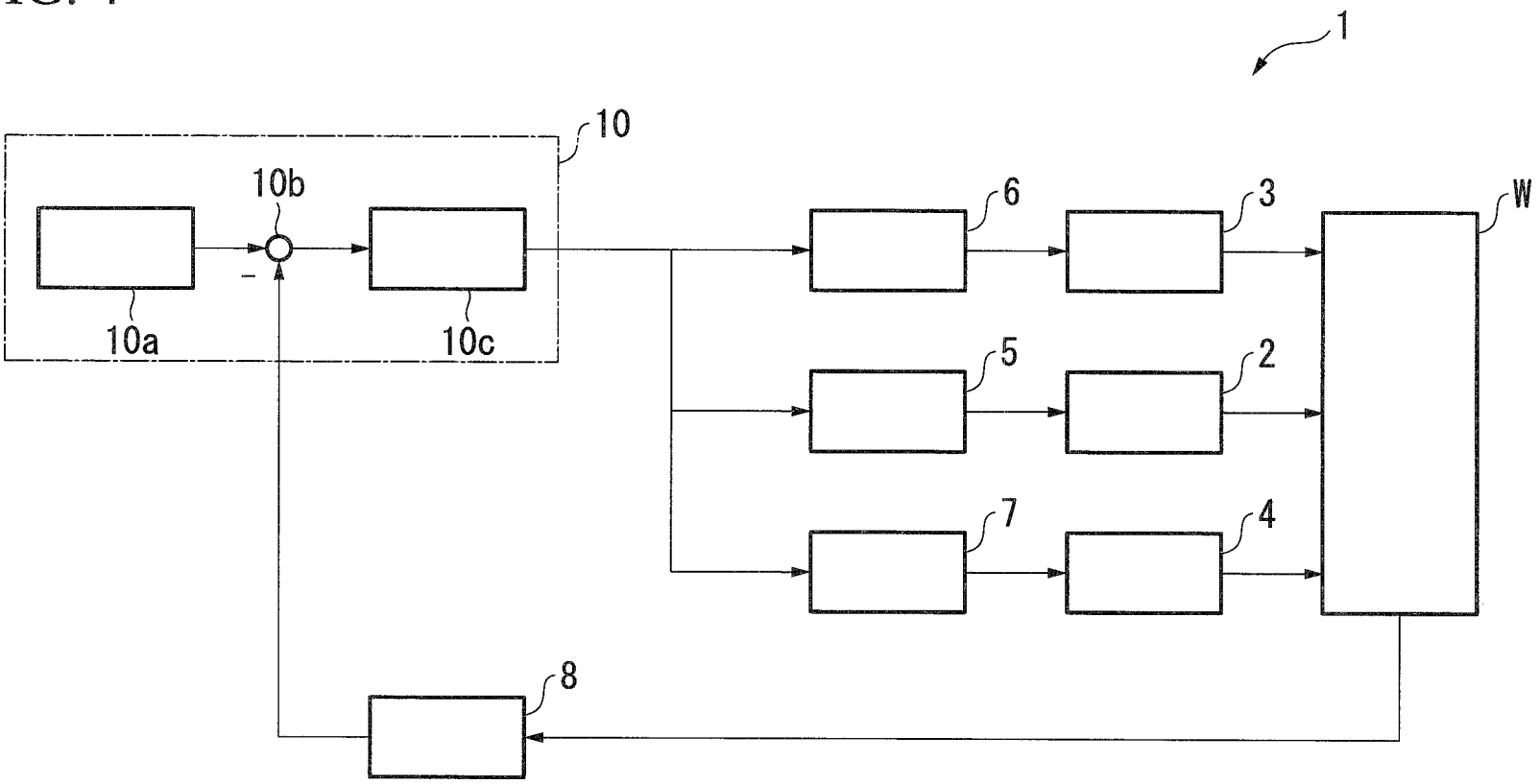
FIG. 4 is a control system diagram when control is performed solely via feedback control in the belt-form body conveyor according to the first embodiment of the present disclosure.

FIG. 4 is a control system diagram when control is performed solely via feedback control in the belt-form body conveyor 1 of the present embodiment. As is shown in FIG. 4, when control is performed solely via feedback control, the control unit 10 is provided with a target value setting unit 10*a*, a subtractor 10*b*, and a feedback calculating unit 10*c*. The target value setting unit 10*a* sets a target value for an edge position (i.e., an edge position on the side closest to the viewer in FIG. 1 and FIG. 2) of the belt-form body W after the belt-form body W has passed through the downstream-side turn bar 2. The target value setting unit 10*a* sets a previously stored value or a value that has been input from the outside as the target value. The subtractor 10*b* calculates a difference between the detection result from the downstream-side edge sensor 8 and the target value. The feedback calculating unit 10*c* performs PID processing, for example, based on the difference, which is calculated by the subtractor 10*b*, between the detection result from the downstream-side edge sensor 8 and the target value, and then calculates the rotation angle θ of the downstream-side turn bar 2, the upstream-side turn bar 3, and the inverter turn bar 4.

Based on the rotation angle θ calculated by the control unit 10 in this manner, control of the downstream-side actuator 5, the upstream-side actuator 6, and the inversion actuator 7 is performed, and the downstream-side turn bar 2, the upstream-side turn bar 3, and the inverter turn bar 4 are rotated.

When the downstream-side turn bar 2, the upstream-side turn bar 3, and the inverter turn bar 4 are rotated in this way, firstly, the position where the edge on one side in the width direction of the belt-form body W and the position where the edge on the other side in the width direction of the belt-form body W arrive at the upstream-side turn bar 3 become mutually different. For example, as is shown by the single-dot chain line in FIG. 3, when the upstream-side turn bar 3 is rotated to the right, the edge on the side furthest from the viewer in FIG. 1 and FIG. 2 arrives at the upstream-side turn bar 3 before the edge on the side closest to the viewer arrives at the upstream-side turn bar 3. As a consequence, as is shown in FIG. 2, the belt-form body W is twisted in a spiral configuration following the upstream-side turn bar 3, and the travel direction of the belt-form body W after the belt-form body W has passed through the upstream-side turn bar 3 is obliquely inclined in the width direction of the belt-form body W relative to a normal line of the belt-form body W before being supplied to the upstream-side turn bar 3. In this way, after the travel direction of the belt-form body W is obliquely inclined by the upstream-side turn bar 3, the travel direction of the belt-form body W is inverted by the inverter turn bar 4, and then the belt-form body W arrives at the downstream-side turn bar 2 with the travel direction thereof remaining obliquely inclined relative to the normal line of the belt-form body W before being supplied to the upstream-side turn bar 3. In the downstream-side turn bar 2, the belt-form body W is twisted in a spiral configuration in the opposite direction from that imparted by the upstream-side turn bar 3, so that the twist in the belt-form body W is canceled out. Here, between exiting the upstream-side turn bar 3 and arriving at the downstream-side turn bar 2, the belt-form body W travels in an obliquely inclined state relative to the normal line of the belt-form body W before being supplied to the upstream-side turn bar 3. As a result, portions of the belt-form body W that have finished passing through the downstream-side turn bar 2 undergo a parallel displacement in the width direction relative to portions of the belt-form body W that have not yet been supplied to the upstream-side turn bar 3.

As a result of the edge positions of the belt-form body W that have undergone a parallel displacement in this way once again being detected by the downstream-side edge sensor 8, and these detection results being input into the control unit 10, feedback control is performed continuously in this control system.

Figure 5:
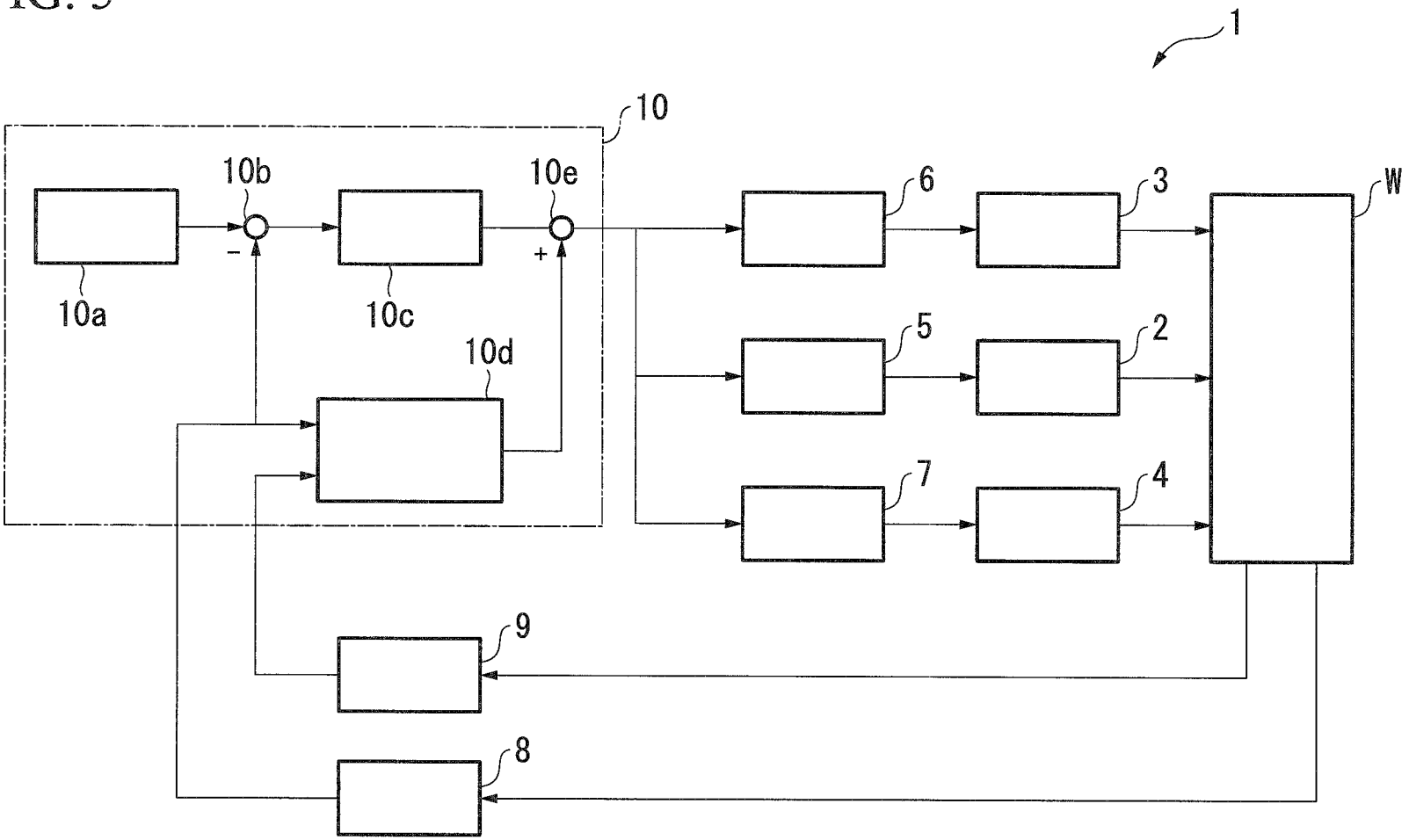
FIG. 5 is a control system diagram when feedforward control is performed in addition to feedback control in the belt-form body conveyor according to the first embodiment of the present disclosure.

FIG. 5 is a control system diagram when feedforward control is performed in addition to feedback control in the belt-form body conveyor 1 of the present embodiment. As is shown in FIG. 5, when feedforward control is performed in addition to feedback control, the control unit 10 is further provided with a feedforward calculating unit 10*d*, and an adder 10*e* in addition to the target value setting unit 10*a*, the subtractor 10*b*, and the feedback calculating unit 10*c*.

The feedforward calculating unit 10*d* calculates a rotation angle θ1 based on the detection results from the downstream-side edge sensor 8 and the detection results from the upstream-side edge sensor 9. In the structure shown in FIG. 5, for example, the rotation angle θ of the downstream-side turn bar 2, the upstream-side turn bar 3, and the inverter turn bar 4 is determined approximately using the rotation angle θ1 calculated by the feedforward control unit 10*d* (i.e., θ≈θ1), and the rotation angle θ is then fine-tuned using a rotation angle θ2 calculated by the feedback calculating unit 10*c*. Because of this, in the structure shown in FIG. 5, the adder 10*e* adds the rotation angle θ1 calculated by the feedforward calculating unit 10*d* to the rotation angle θ2 calculated by the feedback calculating unit 10*c*, and the rotation angle θ is determined via this process. According to this type of control, responsiveness can be improved compared to when only feedback control is performed.

Figure 6:
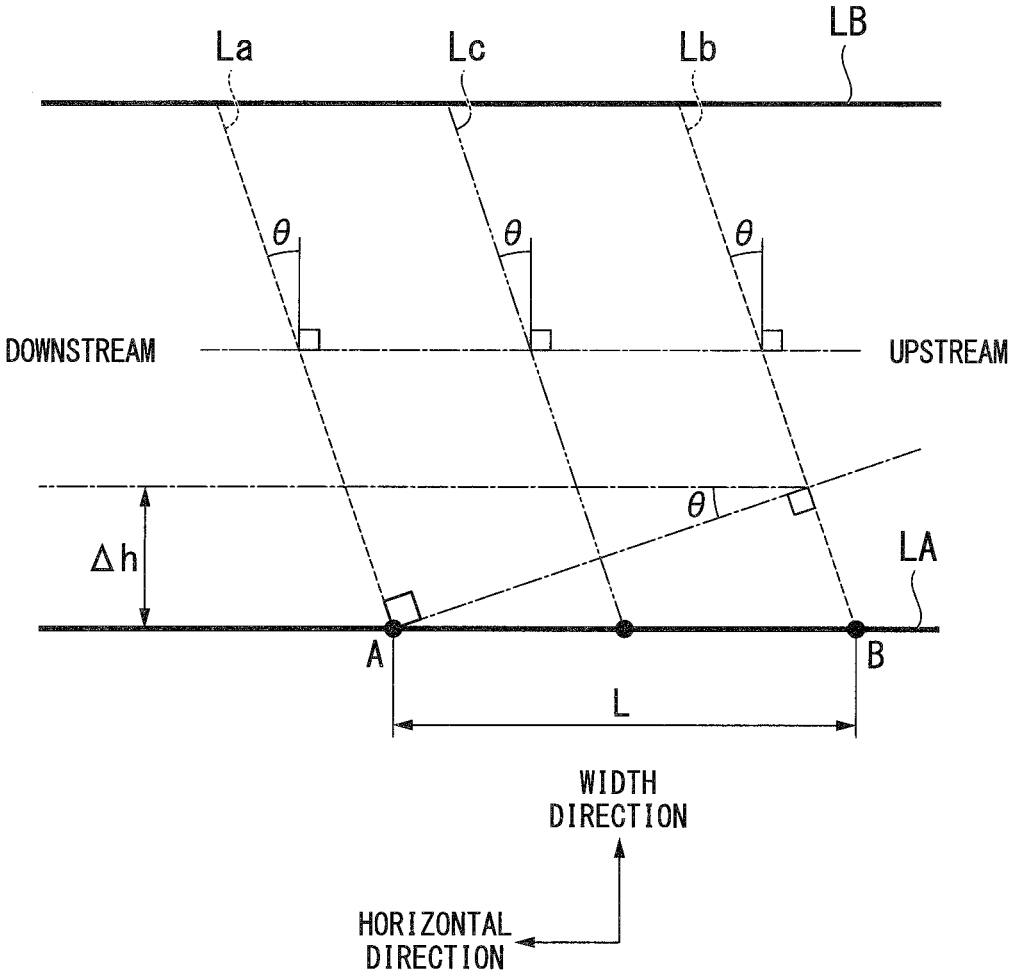
FIG. 6 is an expanded view representing relationships between an amount of parallel displacement, and a rotation angle of the downstream-side turn bar, the upstream-side turn bar, and the inverter turn bar in the belt-form body conveyor according to the first embodiment of the present disclosure.

Here, the specific method used to calculate the rotation angle θ will be described. FIG. 6 is an expanded view representing relationships between an amount of parallel displacement Δh in the width direction and the rotation angle θ of the downstream-side turn bar 2, the upstream-side turn bar 3, and the inverter turn bar 4 in the belt-form body conveyor 1 of the present embodiment represented in FIG. 2. As is shown in FIG. 6, if the rotation angle of the axial center La of the downstream-side turn bar 2, the axial center Lb of the upstream-side turn bar 3, and the axial center Lc of the inverter turn bar 4 is taken as θ, a straight line superimposed on the edge on one side of the belt-form body W before being supplied to the downstream-side turn bar 2 is taken as a straight line LA, a straight line superimposed on the edge on the other side of the belt-form body W before being supplied to the downstream-side turn bar 2 is taken as a straight line LB, a point of intersection between the axial center La and the straight line LA is taken as a point A, a point of intersection between the axial center Lb and the straight line LA is taken as a point B, and a path length from the axial enter La to the axial center Lb is taken as L, then the amount of parallel displacement Δh can be represented by the following Equation (1). Note that, in a practical application, if the path length L is, for example, several meters, then because the amount of parallel displacement Δh is, for example, several millimeters, the approximation formula of Equation (1) is valid.

[Equation 1]

$$\Delta h = y1 - y2 = L \times \cos\theta \times \sin\theta \approx L \times \sin\theta \approx L \times \sin\theta 1 \quad (1)$$

As a consequence, the control unit 10 is able to determine Δh based on the detection results from the downstream-side edge sensor 8, the detection results from the upstream-side edge sensor 9, and the target value set by the target value setting unit 10*a*, and is able to calculate the rotation angle θ1 using the following Equation (2). Note that, in Equation (2), y1 represents the detection results from the downstream-side edge sensor 8, and y2 represents the detection results from the upstream-side edge sensor 9.

[Equation 2]

$$\theta 1 = \sin^{-1}(\Delta h/L) = \sin^{-1}((y1 - y2)/L) \quad (2)$$

According to the above-described belt-form body conveyor 1 of the present embodiment, the downstream-side turn bar 2, the upstream-side turn bar 3, and the inverter turn bar 4 that support the belt-form body W in a non-contact manner are rotated in the same direction and by the same angle. As a consequence, the belt-form body W is wound in a spiral configuration over the downstream-side turn bar 2, the upstream-side turn bar 3, and the inverter turn bar 4, and the portions of the belt-form body W that have passed through the downstream-side turn bar 2 can perform a parallel displacement in the width direction of the belt-form body W relative to the portions of the belt-form body W that have not yet been supplied to the upstream-side turn bar 3. Accordingly, according to the present disclosure, the belt-form body W can perform a parallel displacement in the width direction without any stress being applied to the belt-form body W.

Moreover, in the belt-form body conveyor 1 of the present embodiment, the belt-form body W is guided using the rod-shaped downstream-side turn bar 2, upstream-side turn bar 3, and inverter turn bar 4. Because of this, compared with when the belt-shaped body W is guided using non-contact guide portions that do not have a rod-shaped configuration, the configuration of the non-contact guide portions can be simplified, and the apparatus structure can be simplified.

In addition, the belt-form body conveyor 1 of the present embodiment is provided with the downstream-side edge sensor 8 and the upstream-side edge sensor 9, and is also provided with the control unit 10 that, based on detection results from the downstream-side edge sensor 8 and the upstream-side edge sensor 9, controls the downstream-side actuator 5, the upstream-side actuator 6, and the inversion actuator 7. Because of this, the position of the belt-form body W can be adjusted automatically and accurately.

Second Embodiment

Next, a second embodiment of the present disclosure will described with reference made to FIG. 7 through FIG. 11. Note that in the description of the present embodiment, any description of portions that are the same as in the above-described first embodiment is either omitted or simplified.

Figure 7:
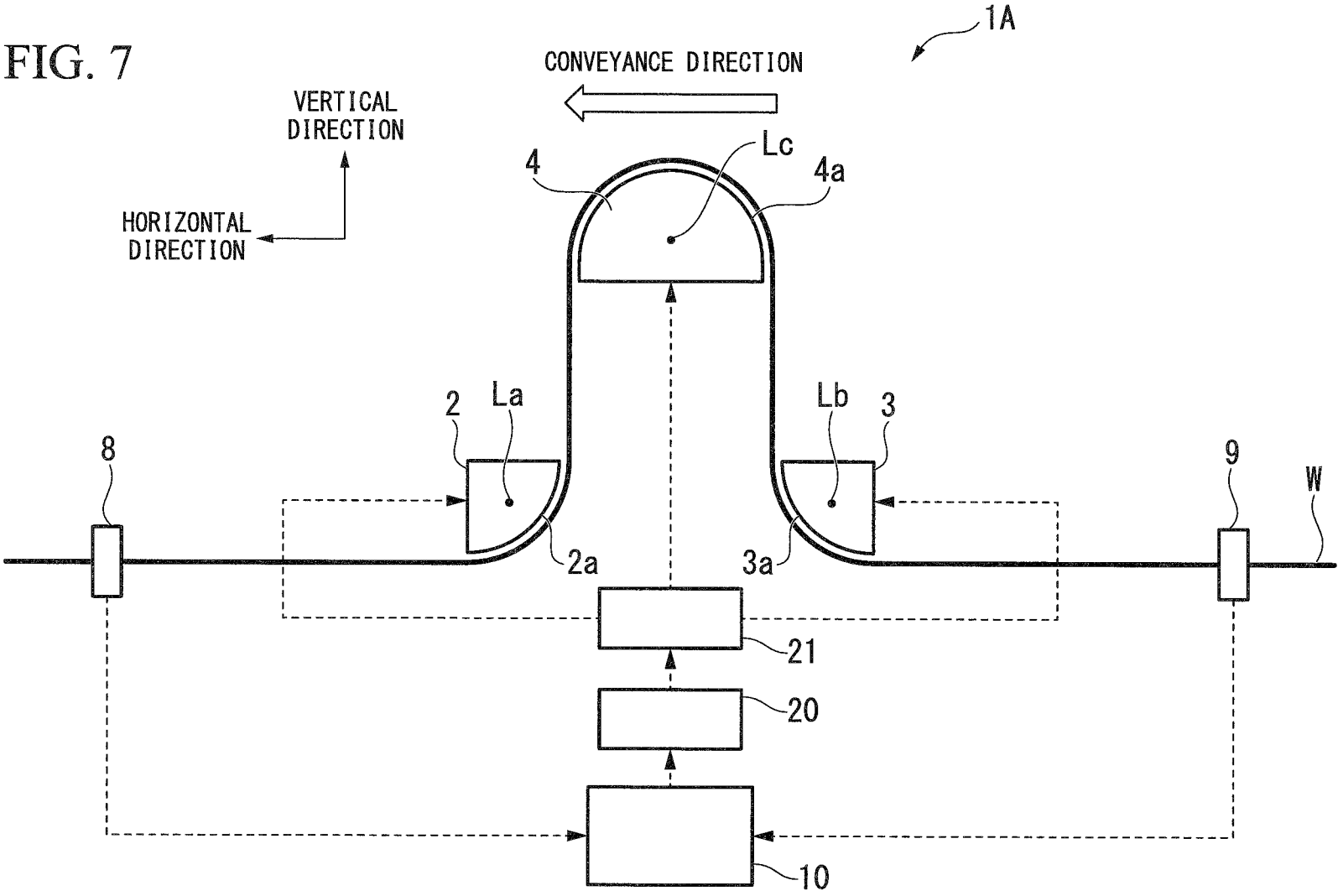
FIG. 7 is a side view schematically representing a structural outline of a belt-form body conveyor according to a second embodiment of the present disclosure.
Figure 8:
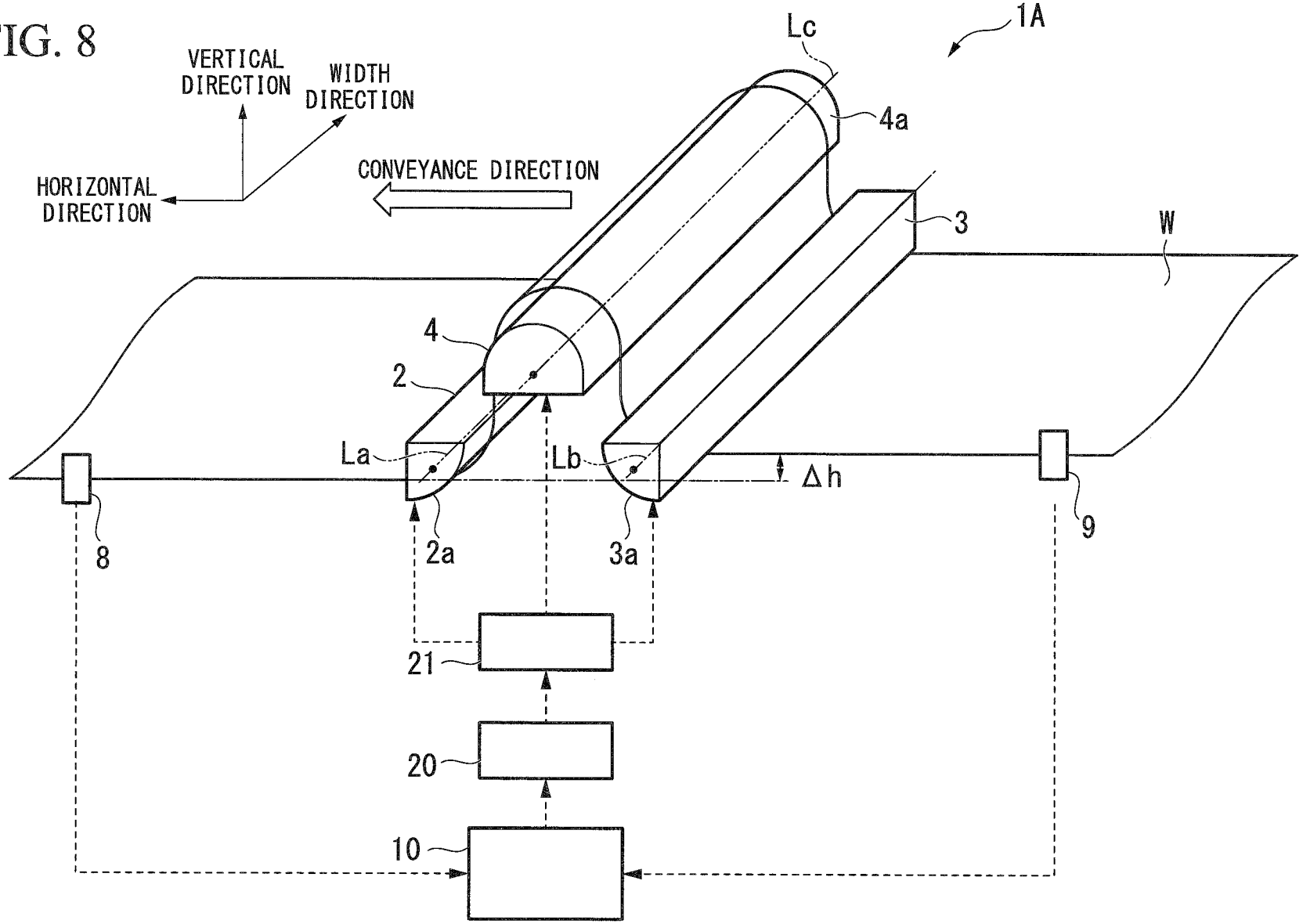
FIG. 8 is a perspective view schematically representing the structural outline of the belt-form body conveyor according to the second embodiment of the present disclosure.

FIG. 7 is a side view schematically representing a structural outline of a belt-form body conveyor 1A according to the present embodiment. In addition, FIG. 8 is a perspective view schematically representing a structural outline of the belt-form body conveyor 1A according to the present embodiment. Note that, in the belt-form body conveyor 1A of the present embodiment as well, the belt-form body W is conveyed from the right side towards the left side in FIG. 7 and FIG. 8. Namely, in the present embodiment, as is indicated by the arrows in FIG. 7 and FIG. 8, a direction towards the left-hand side in FIG. 7 and FIG. 8 is the principal conveyance direction of the belt-form body W. Moreover, the right side in FIG. 7 and FIG. 8 is the upstream side in the conveyance direction, while the left side in FIG. 7 and FIG. 8 is the downstream side in the conveyance direction.

Note also that in FIG. 7, a state is illustrated in which the axial center of the downstream-side turn bar 2, the axial center of the upstream-side turn bar 3, and the axial center of the inverter turn bar 4 extend in parallel with the width direction of the belt-form body W. Moreover, in FIG. 8, a state is illustrated in which the axial center of the downstream-side turn bar 2, the axial center of the upstream-side turn bar 3, and the axial center of the inverter turn bar 4 are obliquely inclined relative to the width direction of the belt-form body W.

As is shown in these drawings, the belt-form body conveyor 1A of the present embodiment is not provided with the downstream-side actuator 5, the upstream-side actuator 6, and the inversion actuator 7 that are provided in the belt-form body conveyor 1 of the first embodiment, but is instead provided with a single actuator 20. Furthermore, the belt-form body conveyor 1A of the present embodiment is also provided with a link mechanism 21 that connects the actuator 20 to each of the downstream-side turn bar 2, the upstream-side turn bar 3, and the inverter turn bar 4.

The actuator 20 generates motive force that is used to rotate all of the downstream-side turn bar 2, the upstream-side turn bar 3, and the inverter turn bar 4. A direct drive actuator, for example, may be used as the actuator 20. The link mechanism 21 transmits the motive force generated by the actuator 20 to each one of the downstream-side turn bar 2, the upstream-side turn bar 3, and the inverter turn bar 4 and thereby causes the downstream-side turn bar 2, the upstream-side turn bar 3, and the inverter turn bar 4 to rotate simultaneously. By providing the link mechanism 21, it is no longer necessary to install an actuator for each one of the downstream-side turn bar 2, the upstream-side turn bar 3, and the inverter turn bar 4. As a result, the apparatus structure can be further simplified.

Figure 9:
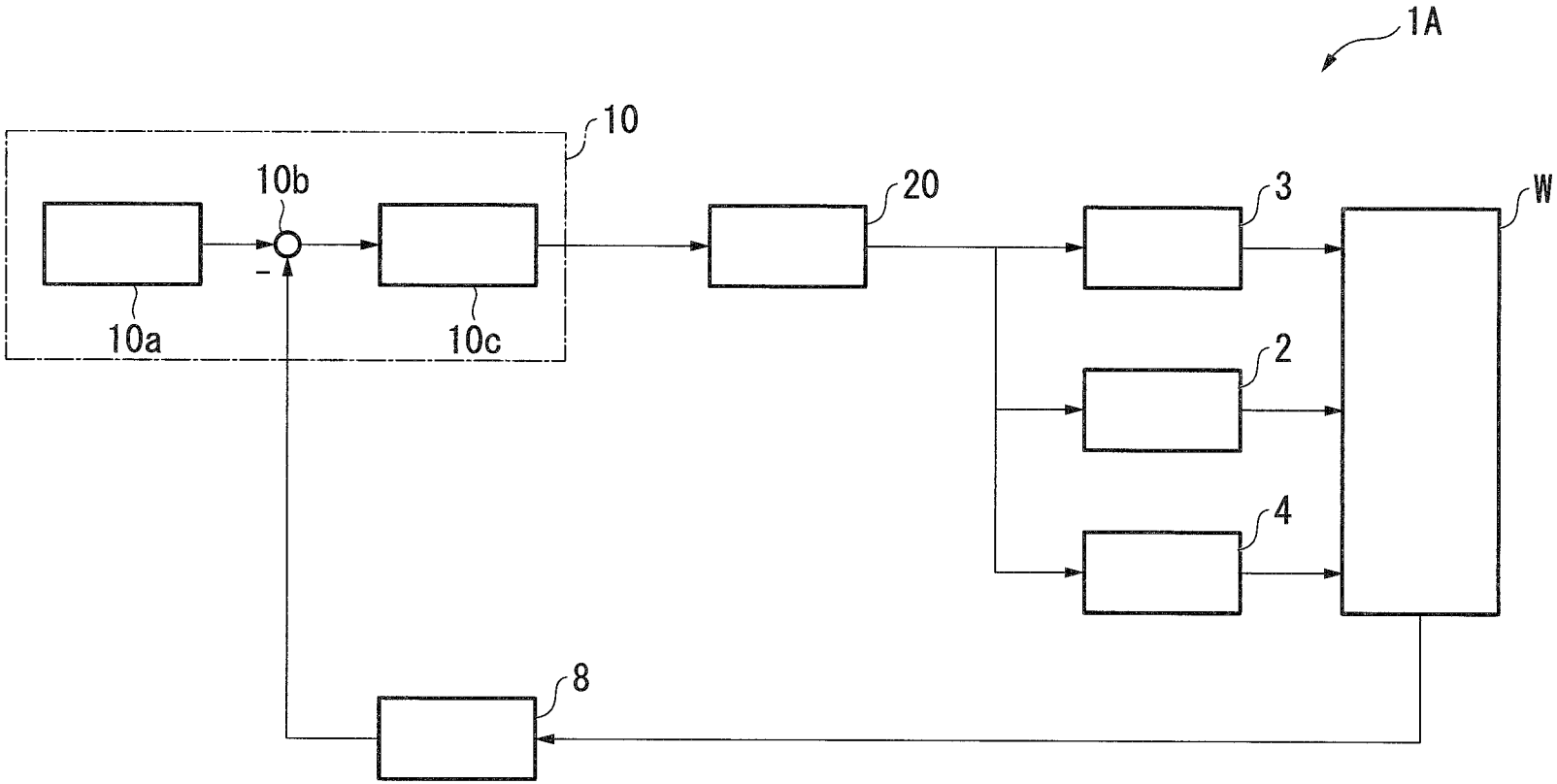
FIG. 9 is a control system diagram when control is performed solely via feedback control in the belt-form body conveyor according to the second embodiment of the present disclosure.
Figure 10:
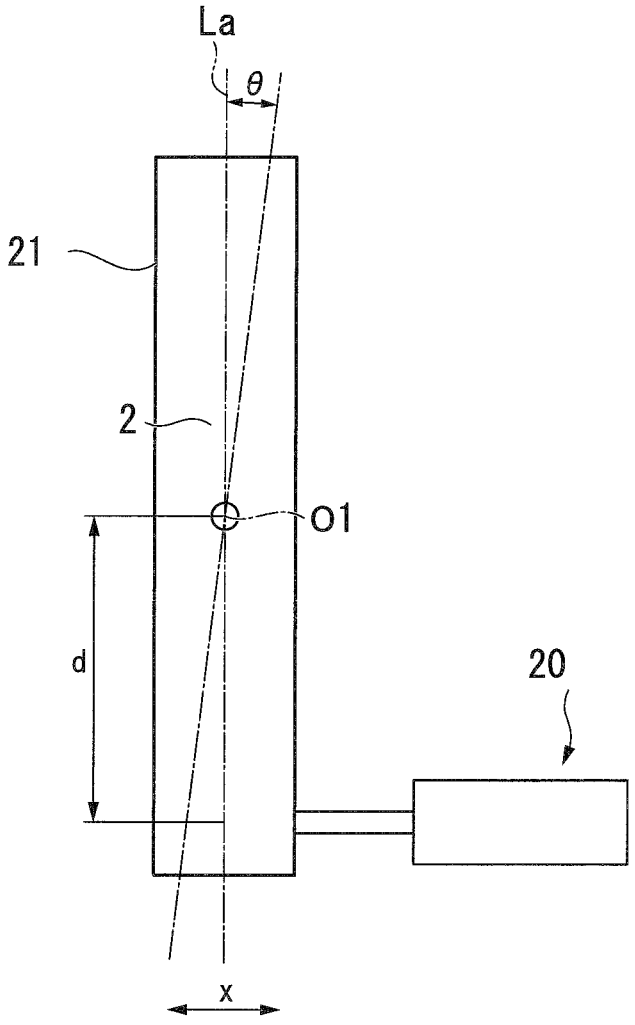
FIG. 10 is a schematic view illustrating an action of a link mechanism of the belt-form body conveyor according to the second embodiment of the present disclosure.

FIG. 9 is a control system diagram when control is performed solely via feedback control in the belt-form body conveyor 1A according to the present embodiment. As is shown in FIG. 9, in the belt-form body conveyor 1A of the present embodiment, because only the single actuator 20 is installed, the feedback calculating unit 10*c* calculates the drive amount of the actuator 20. For example, if the actuator 20 is a direct drive actuator, and, as is shown in FIG. 10, is connected to one end of the rod-shaped link mechanism 21 so as to be able to rotate the axial center La, then if the drive amount of the actuator 20 is taken as x, and the distance from a point of connection between the actuator 20 and the link mechanism 21 to the center position O1 of the axial center La is taken as d, the rotation angle θ and the drive amount x of the actuator 20 can be shown using the following Equation (3). Because of this, the feedback calculating unit 10*c* calculates the drive amount x based, for example, on Equation (3).

[Equation 3]

$$\theta=\sin^{-1}(x/d) \tag{3}$$

Figure 11:
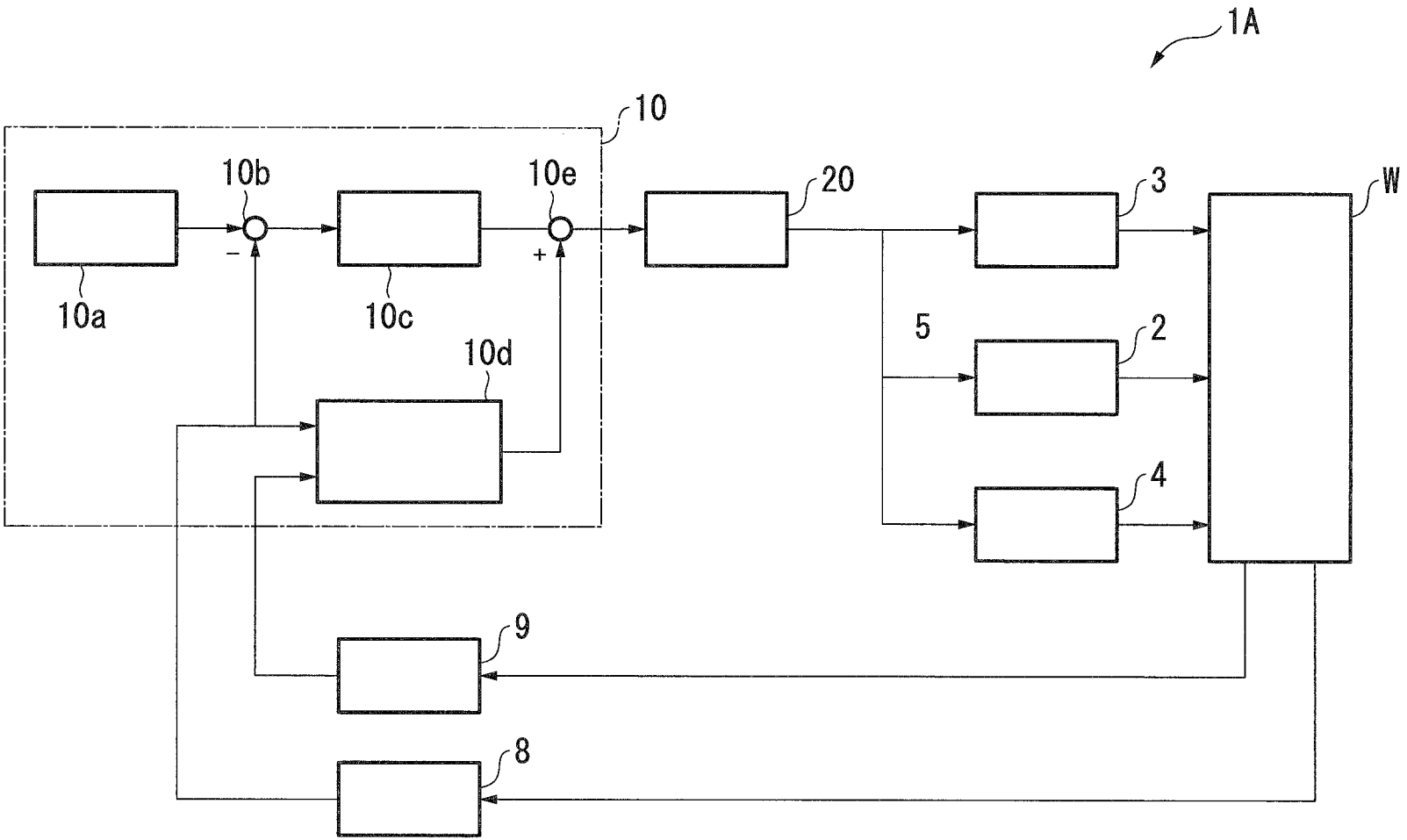
FIG. 11 is a control system diagram when feedforward control is performed in addition to feedback control in the belt-form body conveyor according to the second embodiment of the present disclosure.

FIG. 11 is a control system diagram when feedforward control is performed in addition to feedback control in the belt-form body conveyor 1A of the present embodiment. As is shown in FIG. 11, when feedforward control is performed in addition to feedback control, the feedforward calculating unit 10*d* calculates a drive amount x1 of the actuator 20 based on detection results from the downstream-side edge sensor 8 and on detection results from the upstream-side edge sensor 9. Here, the drive amount x1 is calculated based, for example, on the following Equation (4). Note that Equation (4) is derived based on the following Equation (5), the following Equation (6), and Equation (3).

[Equation 4]

$$x=d\times(y1-y2)/L \tag{4}$$

[Equation 5]

$$\Delta h=y1-y2=L\times\cos\theta\times\sin\theta\approx L\sin\theta \tag{5}$$

[Equation 6]

$$\theta=\sin^{-1}((y1-y2)/L) \tag{6}$$

Moreover, in the structure shown in FIG. 11, for example, the drive amount x of the actuator 20 is determined approximately using the drive amount x1 calculated by the feedforward control unit 10*d*, and the drive amount x is then fine-tuned using a drive amount x2 calculated by the feedback calculating unit 10*c*. Because of this, in the structure shown in FIG. 11, the adder 10*e* adds the drive amount x1 calculated by the feedforward calculating unit 10*d* to the drive amount x2 calculated by the feedback calculating unit 10*c*, and the drive amount x is determined via this process. According to this type of control, responsiveness can be improved compared to when only feedback control is performed.

According to the above-described belt-form body conveyor 1A of the present embodiment, because only the single actuator 20 is provided, control can be simplified compared with when the downstream-side actuator 5, the upstream-side actuator 6, and the inversion actuator 7 are provided.

While preferred embodiments of the present disclosure have been described above with reference made to the drawings, it should be understood that the present disclosure is not limited to the above-described embodiments. The various configurations and combinations and the like of the respective component elements illustrated in the above-described embodiments are merely examples thereof, and various modifications and the like may be made based on design requirements insofar as they do not depart from the spirit or scope of the present disclosure.

For example, in the above-described embodiments, the downstream-side turn bar 2, the upstream-side turn bar 3, and the inverter turn bar 4 are provided as the non-contact guide portions of the present disclosure. However, the present disclosure is not limited to this and a non-contact guide portion that is not rod-shaped but has some other configuration may be provided. In this case, it is not necessary that all of the non-contact guide portions have the same configuration.

Furthermore, the inverter turn bar 4 may be omitted and the downstream-side turn bar 2 and the upstream-side turn bar 3 may be disposed so that the height of downstream-side turn bar 2 is different from the height of the upstream-side turn bar 3. In a case such as this, the height of the belt-form body W before being supplied to the upstream-side turn bar 3 is different from the height of the belt-form body W after the belt-form body W has exited the downstream-side turn bar 2, however, the belt-form body W can still be made to perform a parallel displacement in the width direction.

Furthermore, only two non-contact guide portions, or four or more (i.e., a plurality of) non-contact guide portions may be provided. If three or more non-contact guide portions are provided, then it is not necessary that all of these non-contact guide portions be rotated, and it is sufficient if at least two non-contact guide portions are rotated by the same angle and in the same direction. In a case such as this, the deformation of the belt-form body W is permitted by the change in the distance between the non-contact guide portion not being rotated and the belt-form body W. For example, in the above-described first embodiment, if the downstream-side turn bar 2 and the upstream-side turn bar 3 are rotated without the inverter turn bar 4 being rotated, some parts of the belt-form body W that is being guided by the downstream-side turn bar 2 and the upstream-side turn bar 3 move closer to the inverter turn bar 4, or move away from the inverter turn bar 4, while maintaining the non-contact state. In a case such as this as well, a state in which the belt-form body W is supported in a non-contact manner by the inverter turn bar 4 is maintained.

Furthermore, in the above-described embodiments, the downstream-side edge sensor 8 and the upstream-side edge sensor 9 are provided. However, provided that a sensor that is capable of detecting edge positions of the belt-form body W is used, then the number of sensors installed and the locations of their installation are not limited to those in the above-described embodiments.

Furthermore, in the above-described embodiments, the belt-form body W is supported in a non-contact manner by the expulsion of jets of fluid. However, the present disclosure is not limited to this, and the belt-form body W may be supported in a non-contact manner using, for example, magnetic force or electrostatic force.

The belt-form body W of the above-described embodiments may be a belt-form body made from a brittle material such as, for example, glass, ceramics, or silicon or the like or, alternatively, may be a film made from an organic material or the like. If the belt-form body is made from glass, then ultrathin glass having a thickness of, for example, 0.2 mm or less may also be used.

Furthermore, in the above-described embodiments, a structure in which the principal conveyance direction of the belt-form body W is the horizontal direction is described. However, the present disclosure is not limited to this, and the principal conveyance direction of the belt-form body W may be a direction other than the horizontal direction by tilting the entire apparatus structure of the above-described embodiments.

Furthermore, in the above-described embodiments, a structure in which every one of the downstream-side turn bar 2, the upstream-side turn bar 3, and the inverter turn bar 4 are rotated is described. However, the present disclosure is not limited to this and, for example, only the downstream-side turn bar 2 and the upstream-side turn bar 3 may be rotated.

Furthermore, in the above-described embodiments, the control unit 10 performs feedback control, or else performs feedforward control together with feedback control. However, the present disclosure is not limited to this and, for example, the control unit 10 may only perform feedforward control.

INDUSTRIAL APPLICABILITY

According to the present disclosure, in a belt-form body conveyor that conveys a belt-form body while supporting the belt-form body in a non-contact manner, it is possible for the belt-form body to perform a parallel displacement in the width direction thereof without any stress being placed on the belt-form body.

What is claimed is:

1. A belt-form body conveyor that conveys a belt-form body comprising:

a plurality of non-contact guide portions over which portions of the belt-form body are wound, and that support the belt-form body in a non-contact manner; and a drive unit that causes at least two non-contact guide portions out of the plurality of non-contact guide portions to rotate wherein the plurality of non-contact guide portions include:

an upstream-side turn bar that, of the plurality of non-contact guide portions, is disposed further on an upstream side in a travel direction of the belt-form body, and alters the travel direction of the belt-form body;

a downstream-side turn bar that, of the plurality of non-contact guide portions, is disposed furthest on a downstream side in the travel direction of the belt-form body, and causes a position of the belt-form body in a thickness direction of the belt-form body to match the position of the belt-form body before the belt-form body is supplied to the upstream-side turn bar; and an inverter turn bar that reverses the travel direction of the belt-form body, which has been altered by the upstream-side turn bar, towards the downstream-side turn bar, and wherein the upstream-side turn bar, the downstream-side turn bar and the inverter turn bar are rotated in the same direction and by the same angle when viewed in a direction that is perpendicular to a surface of the belt-form body before the belt-form body is supplied to the plurality of non-contact guide portions.

2. The belt-form body conveyor according to claim 1, further comprising:

an upstream-side edge sensor that is disposed on the upstream side of the upstream-side turn bar, and detects an edge position of the belt-form body;

a downstream-side edge sensor that is disposed on the downstream side of the downstream-side turn bar, and detects an edge position of the belt-form body; and a control unit that controls the drive unit based on at least one of a detection result from the upstream-side edge sensor and a detection result from the downstream-side edge sensor.

3. The belt-form body conveyor according to claim 2, wherein the drive unit includes:

an actuator; and a link mechanism that transmits motive force generated by the actuator to the at least two non-contact guide portions.

4. The belt-form body conveyor according to claim 1, wherein the drive unit includes:

an actuator; and a link mechanism that transmits motive force generated by the actuator to the at least two non-contact guide portions.

* * * * *